United States Patent [19]

Rodgers

[11] 4,453,362

[45] Jun. 12, 1984

[54] WALL SUPPORT DEVICE

[76] Inventor: Alden E. Rodgers, 3824 Scranton Dr., Fort Worth, Tex. 76118

[21] Appl. No.: 390,275

[22] Filed: Jun. 21, 1982

[51] Int. Cl.[3] ..... E04B 1/38

[52] U.S. Cl. ..... 52/481; 52/696; 52/713

[58] Field of Search ..... 52/317, 632, 357, 481, 52/695, 696, 713

[56] References Cited

U.S. PATENT DOCUMENTS

| | | | |
|---|---|---|---|
| 1,412,736 | 4/1922 | Hamilton | 52/317 |
| 1,867,449 | 7/1932 | Ecket et al. . | |
| 3,010,162 | 11/1961 | Klein | 20/9 |
| 3,334,461 | 8/1967 | York | 52/317 |
| 3,370,391 | 2/1968 | Dupuis et al. | 52/346 |
| 3,914,914 | 10/1975 | Jureit et al. | 52/632 |
| 3,958,386 | 5/1976 | Pollock | 52/488 |
| 4,007,570 | 2/1977 | Hunter | 52/317 |
| 4,069,636 | 1/1978 | Kessler | 52/357 |
| 4,237,669 | 12/1980 | Hunter | 52/417 |

*Primary Examiner*—James L. Ridgill, Jr.
*Attorney, Agent, or Firm*—James E. Bradley

[57] ABSTRACT

A wall support device is shown for installation between spaced structural members such as metallic studs in a wall, the structural members being of the type having external sidewalls arranged to define an open interior. The wall support device has an elongated support section which can be sized to fit between two such spaced structural members. A bracing flange at one end of the support section extends outwardly from the support section approximately normal thereto for abutting an external sidewall of one of the spaced structural members. A locking flange at the end of the support section opposite the bracing flange is adapted to be received within the open interior of the other of the spaced structural members for securing the support section between the two spaced structural members.

7 Claims, 3 Drawing Figures

WALL SUPPORT DEVICE

BACKGROUND OF THE INVENTION

The present invention relates generally to interior building construction techniques and specifically to a wall support device for installation between spaced structural members such as studs in a wall.

In the past, most residential and small commercial buildings were composed primarily of wood framing structures including studs, joists and rafters. Today, however, various nonwood components are being offered for use in such structures to replace, at least in part, the use of wood elements. Also, the increasing use of prefabricated structures and materials as modular components in building construction has brought about a greater use of metal studs, joists, and rafters.

In the typical construction job, the bracing of structural members such as the wall studs is a costly and time consuming operation even where metal structural members are used. Bracing is necessary, as where fixtures such as bathroom appliances will be hung on the walls, or in order to eliminate seam lines where the edges of two wall sections abut. Various devices have been suggested for use with metal studs which have generally involved complicated assembly of numerous parts or the use of time consuming procedures for securing the bracing between the studs. Such devices often involve the use of specially constructed metal studs with tracks, holes, or special mounting receptacles to receive bendable tabs or the like and hence were more costly and often more time consuming to use.

A need exists, therefore, for a wall support device for installation betwen spaced structural members such as metal studs in a wall which can quickly and easily be applied to connect the structural members without requiring the use of specially constructed studs or additional mounting materials.

A need also exists for such a wall support device which would be efficient and economical to use and which would reduce the labor costs in bracing to a minimum.

SUMMARY OF THE INVENTION

The wall support device of the invention is intended to be installed between spaced structural members in a wall, the structural members being of the type having external sidewalls arranged to define an open interior. The wall support device of the invention has an elongated support section selectively sizable to fit between two spaced structural members in the wall. A bracing flange at one end of the support section extends outwardly from the support section approximately normal thereto for abutting an external sidewall of one of the spaced structural members. A locking flange at the end of the support section opposite the bracing flange is adapted to be received within the open interior of the other of the spaced structural members for securing the support section between the two spaced structural members.

Preferably, the wall support device is used between spaced structural members of the type having a flat longitudinal portion with opposing side portions extending outwardly therefrom and normal thereto, each of the opposing side portions having an end flange extending inwardly normal to the side sections, the end flanges being spaced-apart to define an open interior. A pair of telescoping elongate plates are selectively engagable to form a plate-like support section sized to fit between the two spaced structural members in the wall.

The bracing flange at one end of the support section abuts the external flat longitudinal portion of one of the spaced structural members. The locking flange at the end of the support section opposite the bracing flange has a channel portion formed therein. The channel portion has a flat base area and sidewalls extending therefrom. The flat base is adapted to fit flush with one of the opposing side portions in the interior of the structural member. One of the sidewalls of the channel portion angles inwardly in the direction of the bracing flange and is adapted to contact the other opposing side portion in the structural member for securing the support section between the two spaced structural members.

The channel portion sidewall opposite the angled sidewall is bent to form a generally rectangular slot with respect to the elongated support section and the channel base area. The slot opening faces oppositely to the channel opening whereby the rectangular slot can be received on one of the structural member end flanges when the locking flange is secured within the structural member interior.

Both the bracing flange and the locking flange can be provided with protruding teeth at the outer extents thereof for further engaging the respective spaced structural members.

Additional objects, features, and advantages will be apparent in the written description which follows.

DETAILED DESCRIPTION OF THE INVENTION

Figure 1:
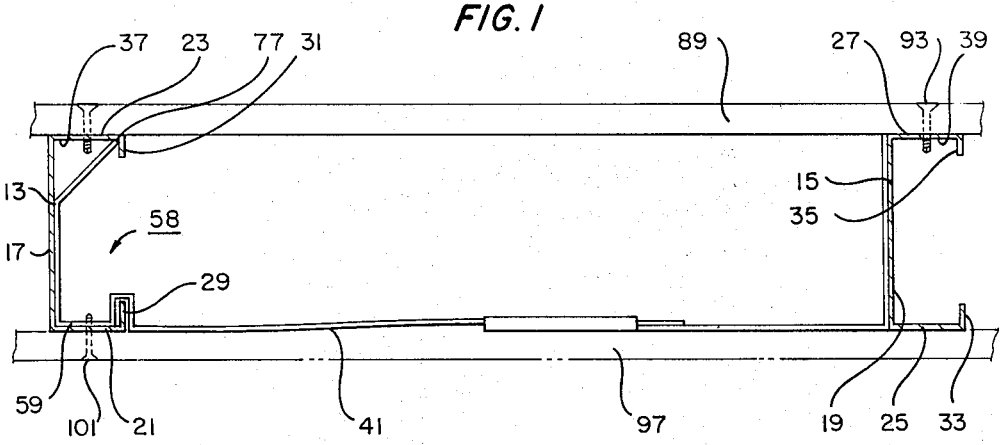
FIG. 1 is a cross-sectional view of a wall support device of the invention shown installed between two spaced structural members in a wall.
Figure 2:
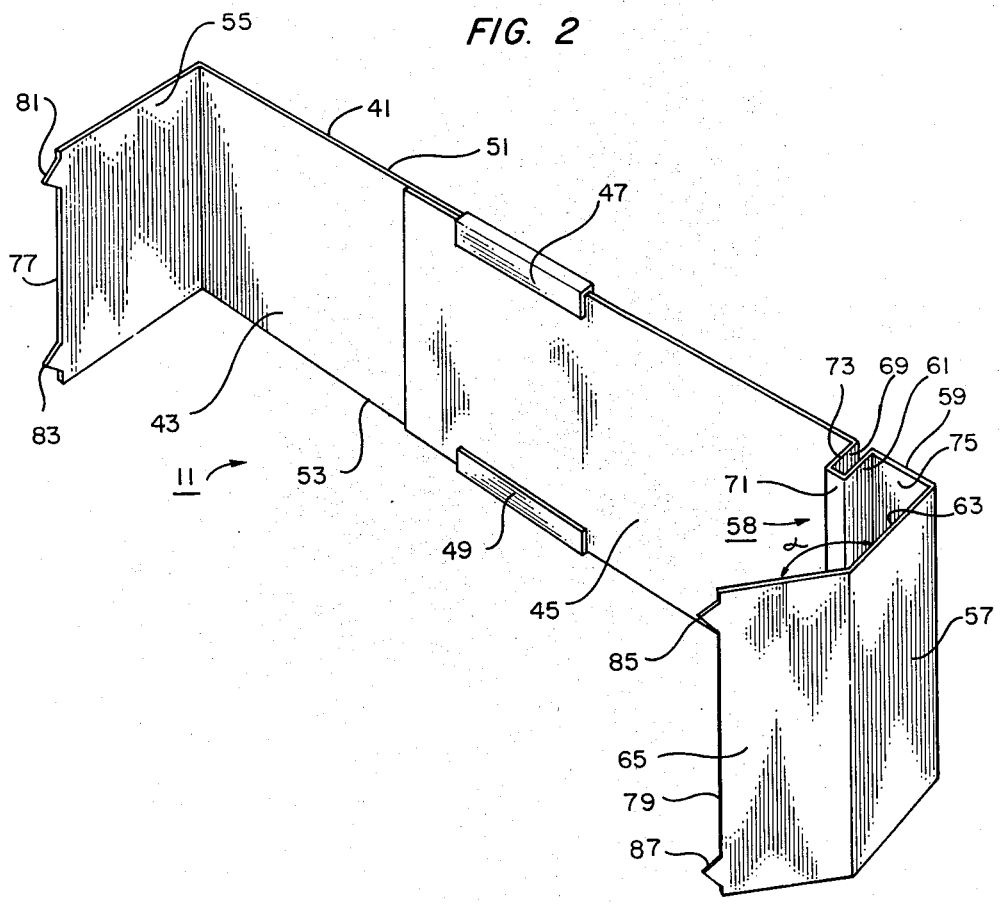
FIG. 2 is an isolated perspective view of the wall support device of FIG. 1.
Figure 3:
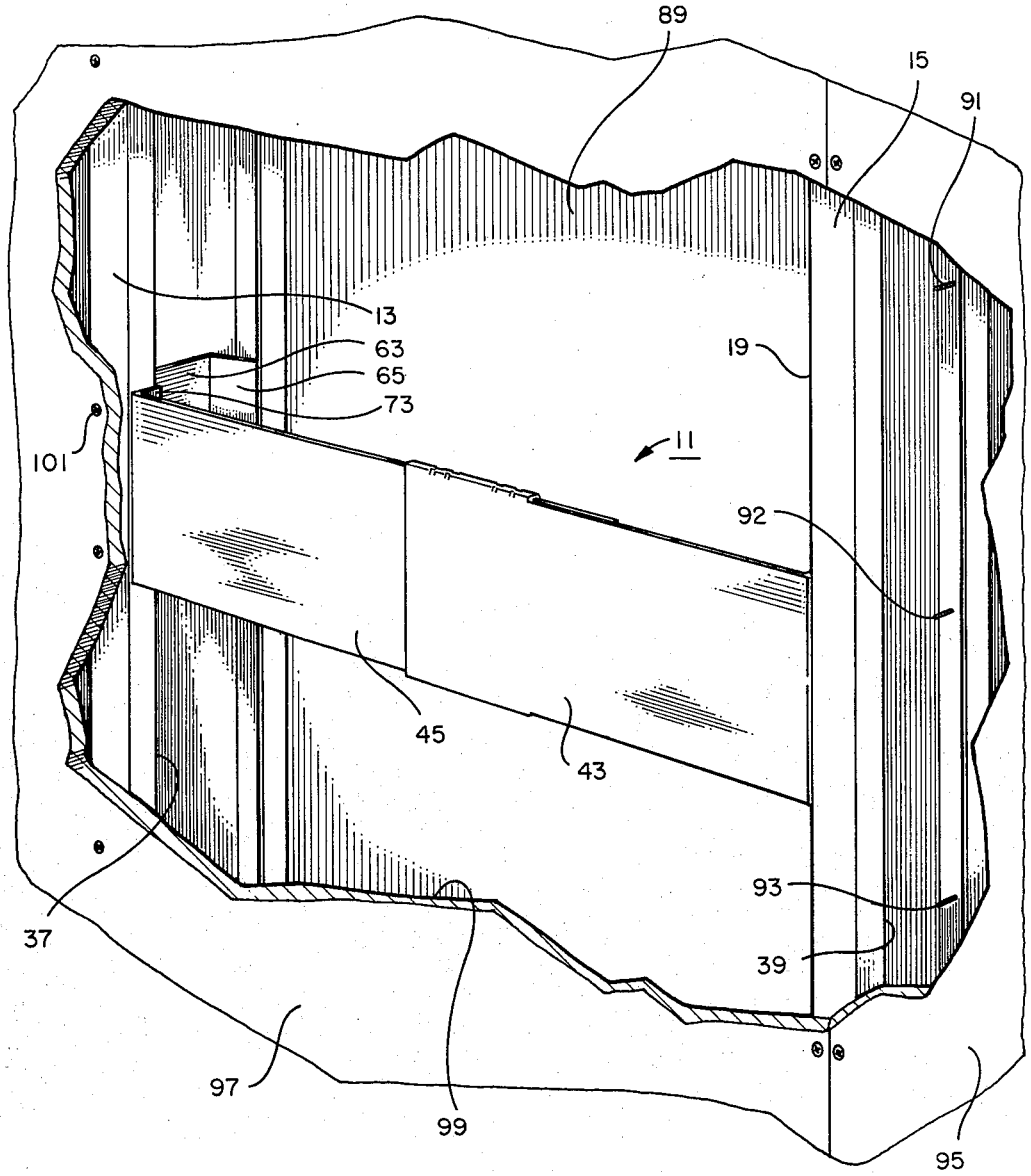
FIG. 3 is a partially cut-away view of a wall showing the wall support device of the invention installed between two spaced structural members in the wall and with the wall boards in place.

Turning to FIG. 2, there is shown a wall support device of the invention designated generally as 11. The wall support device, as shown in FIGS. 1 and 3 is designed for installation between spaced structural members such as metal studs 13, 15 in a wall. The spaced structural members 13, 15 are of the type having external sidewalls arranged to define an open interior. More specifically, the spaced structural members 13, 15 are of the type having a flat longitudinal portion 17, 19 in FIG. 1, with opposing side portions 21, 23 and 25, 27 extending outwardly therefrom and approximately normal thereto. Each of the opposing side portions 21, 23, 25 and 27 has an end flange 29, 31, 33, and 35 extending inwardly generally normal to the side portions, each of the end flanges 29, 31, 33 and 35 being spaced apart to define an open interior 37, 39. Such "C-shaped" metallic studs are known in the construction industry and are commercially available.

The structural members 13, 15 are erected in vertical fashion with respect to the building floor as shown in FIG. 3 with the openings 37, 39 of adjacent structural members facing in the same direction. As shown in FIG. 2, the wall support device 11 has an elongated support section 41 which is selectively sizable to fit between two spaced structural members 13, 15 in a wall. The elongated support section 41 can comprise a pair of telescoping elongate plates 43, 45, which are engagable, as by upper bendable tab 47 and lower bendable tab 49 which extend from the outer edges 51, 53 of support device 43. Once the plates 43, 45 are extended to engage the spaced structural members 13, 15, the tabs 47, 49 can be crimped, as with hand pliers, to thereby engage the support plates 43, 45 to form a plate-like support section sized to fit between the two spaced structural members.

The elongated support section 41 has a bracing flange 55 at one end of the support section 41 which extends outwardly from the support section 41 approximately normal thereto for abutting the flat longitudinal portion 19 of one of the spaced structural members 15 as shown in FIG. 1. Although the bracing flange 55 is shown in FIG. 1 as extending across substantially the entire width of longitudinal portion 19, it should be understood that the brace can be provided in a lesser width with respect to the longitudinal portion 19.

The support section 41 has a locking flange 57 at the end of support section 41 opposite the bracing flange 55 which is adapted to be received within the open interior 37 of the other of the spaced structural members 13 for securing the support section between the two spaced structural members 13, 15. The locking flange 57 has a channel portion 58 formed therein with a flat base area 59 and sidewalls 61, 63 extending therefrom. As shown in FIG. 1, the flat base area 59 is adapted to fit flush with one of the opposing side portions 21 in the interior of the structural member 13. As shown in FIG. 2, one of the sidewalls 63 of the channel portion 58 angles inwardly in the direction of the bracing flange 55 to form an outer portion 65 disposed at an angle $\alpha$ with respect to the continuation of sidewall 63. The angled sidewall portion 65 is adapted to contact the opposing side portion 23 in the structural member 13, as shown in FIG. 1, for securing the support section between the two spaced structural members 13, 15. When in place within open interior 37, sidewall 63 of locking flange 57 also fits flush with the interior surface of the flat longitudinal portion 17 of structural member 13.

The channel portion sidewall 61 opposite the angled sidewall 63 of locking flange 57 is bent to form a generally rectangular slot 69 having a base 71 and a sidewall 73 opposite sidewall 61. Slot 69, as shown in FIG. 2, thus forms an opening which faces oppositely to the channel opening 75 with respect to the plane of the support section 41 and the flat base area 59 of the channel portion 58 of locking flange 57. As shown in FIG. 1, the slot 69 can be received on one of the structural member end flanges 29 when the locking flange 57 is secured within the structural member interior 37.

The support device bracing flange 55 and locking flange 57 both have outer edges 77, 79 which can be provided with one or more protruding teeth 81, and 83, 85 and 87 at the outer extents thereof. The teeth 81, 83 on the bracing flange 55 will engage the wall 89, and the teeth 85, 87 on the locking flange 57 will engage the structural member 13.

The operation of the improved wall support device can perhaps best be understood with reference to FIGS. 1 and 3. The wall support device 11 is preferably made of a lightweight metallic material. As shown in FIG. 3, the rear surface 89 of an existing wall section is shown supported between two spaced metallic studs 13, 15 as by screws 91, 92 and 93. The particular wall section shown in FIG. 3 would be an interior wall which has an end wall section 95, such as would be found at a door frame or the like.

The wall support device 11 is fitted between the two spaced-structural members 13, 15 with the bracing flange 55 abutting the flat longitudinal portion 19 of stud 15 and with the locking flange 57 inserted within the open interior 37 of stud 13. Once the length of the elongated support section 41 has been determined, the elongated plates 43, 45 can be engaged by crimping the tabs 47, 49. As best seen in FIG. 1, when the support device 11 is in place between the two spaced structural members 13, 15, the locking flange slot 69 is received on the structural member flange 29, the flat base area 59 is fitted flush against the opposing side portion 21 of the stud 13, sidewall 63 fits flush against longitudinal portion 17, and the outer edge 77 of the angled sidewall 65 is contacting the junction point of the opposing side portion 23 and end flange 31 in the interior of the structural member 13.

It will be appreciated that at this point in the operation, the wall support device 11 is held in place between the two spaced structural members 13, 15 by frictional engagement without the necessity of screwing the support device 11 to the spaced structural members 13, 15 or to the existing wall section 89. The protruding teeth 81, 83 on bracing flange 55 engage the existing wall section 89 and the protruding teeth 85, 87 on the locking flange 57 engage the interior of the structural member 13 to further engage the wall support device between the respective spaced structural members 13, 15.

The remaining wall section 97, as shown in FIG. 3, can then be positioned and supported against structural members 13, 15 so that the interior surface 99 of the wall section 97 fits flush against the outer surface of the elongated support section 41. Screws 101 can then be run through the remaining wall section 97, through the opposing side portion 21 of the structural member 13 and through the flat base area 59 of the channel portion of the locking flange 57 to further secure the wall support device 11. Additional screws (not shown) can then be run through the remaining wall section 97 and through the elongated support section 41 of the wall support device 11 to further engage the wall.

An invention has been provided with significant advantages. The wall support device of the invention can be made of inexpensive lightweight materials. The support device can be provided in one configuration which will telescope to accommodate dimensional variances between spaced structural members. The improved support device can be positioned by one workman quickly and efficiently thereby reducing the labor cost associated with framing and bracing operations.

The novel bracing flange and locking flange arrangement of the device does not require that the support device be screwed to the existing wall section or require that the device be attached to the flat longitudinal portions of the existing spaced structural members. The screws 101 which join the wall support device 11 to the structural member 13 are run through the exterior of the remaining wall section and through the side portion of the spaced-structural member, thereby speeding the construction process. There are no loose parts to be assembled, holes to drill, or separate brackets to position. The elongated support section 41 once positioned behind the remaining wall section 97 provides adequate strength to support plumbing fixtures, or the like, on the remaining wall.

While the invention has been shown in only one of its forms, it is not thus limited but is susceptible to various changes and modifications without departing from the spirit thereof.

I claim:

1. A wall support device for installation between spaced structural members in a wall, the structural members being of the type having external sidewalls arranged to define an open interior, comprising:

an elongated support section mounted between two spaced structural members in said wall and in the same plane as one of the sidewalls;

bracing means at one end of said support section extending outwardly from said support section approximately normal thereto for abutting an external sidewall of one of said spaced structural members; and locking means at the end of said support section opposite said bracing means adapted to be received within the open interior of the other of said spaced structural members for securing the support section between the two spaced structural members.

2. A wall support device for installation between spaced structural members in a wall, the structural members being of the type having external sidewalls arrranged to define an open interior, comprising:

an elongated support section mounted between two spaced structural members in said wall and in the same plane as one of the sidewalls;

bracing means at one end of said support section extending outwardly from said support section approximately normal thereto for abutting an external sidewall of one of said spaced structural members; and locking means at the end of said support section opposite said bracing means adapted to be received within the open interior of the other of said spaced structural members for securing the support section between the two spaced structural members by frictional engagement.

3. A wall support device for installation between spaced structural members in a wall, the structural members being of the type having external sidewalls arranged to define an open interior, comprising:

a pair of telescoping elongate plates selectively engagable to form a plate-like support section mounted between two spaced structural members in said wall and in the same plane as one of the sidewalls;

a bracing flange at one end of said support section extending outwardly from said support section approximately normal thereto for abutting an external sidewall of one of said spaced structural members; and a locking flange at the end of said support section opposite said bracing flange adapted to be received within the open interior of the other of said spaced structural members for securing the support section between the two spaced structural members by frictional engagement;

wherein said locking flange is provided with protruding teeth at the outer extents thereof for further engaging the spaced structural member; and wherein said bracing flange is provided with protuding teeth at the outer extends thereof for engaging said wall.

4. A wall support device for installation between spaced structural members in a wall, the structural members being of the type having a flat longitudinal portion with opposing side portions extending outwardly therefrom and normal thereto, each of the opposing side portions having an end flange extending inwardly normal to said side portions, said end flanges being spaced-apart to define an open interior, comprising:

an elongated support section mounted between two spaced structural members in said wall and in the same plane as one of the side portions;

a bracing flange at one end of said support section extending outwardly from said support section approximately normal thereto for abutting the external flat longitudinal portion of one of the spaced structural members; and a locking flange at the end of said support section opposite said bracing flange, said locking flange having a channel portion formed therein with a flat base area and sidewalls extending therefrom, said flat base being adapted to fit flush with one of the opposing side portions in the interior of the other of said structural members and wherein one of the sidewalls of said channel portion angles inwardly in the direction of said bracing flange, said angled sidewall being adapted to contact the other opposing side portion in said structural member for securing the support section between the two spaced structural members.

5. The wall support device of claim 4, wherein said channel portion sidewall opposite said angled sidewall is bent to form a generally rectangular slot with respect to said elongated support section and the channel base area, the slot opening facing oppositely to the channel opening, whereby the rectangular slot can be received on one of said structural member end flanges when said locking flange is secured within said structural member interior.

6. The wall support device of claim 5 wherein said elongated support section comprises a pair of telescoping elongate plates selectively engagable to form a plate-like support section.

7. The wall support device of claim 6, wherein both said bracing flange and said locking flange are provided with protruding teeth at the outer extents thereof for further engaging the respective spaced structural members.

* * * * *